US007499560B2

(12) United States Patent
Aschoff et al.

(10) Patent No.: US 7,499,560 B2
(45) Date of Patent: Mar. 3, 2009

(54) HEARING DEVICE WITH INDIVIDUALLY CONFIGURABLE HARDWARE INTERFACE

(75) Inventors: Steffan Aschoff, Bubenreuth (DE); Jörg Bindner, Weisendorf (DE); Matthias Lechner, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 640 days.

(21) Appl. No.: 10/928,773

(22) Filed: Aug. 27, 2004

(65) Prior Publication Data

US 2005/0078845 A1 Apr. 14, 2005

(30) Foreign Application Priority Data

Aug. 27, 2003 (DE) ..... 103 39 485

(51) Int. Cl.
*H04R 25/00* (2006.01)

(52) U.S. Cl. ..... 381/323; 381/314; 381/312

(58) Field of Classification Search ..... 381/60, 381/312–315, 323
See application file for complete search history.

(56) References Cited

U.S. PATENT DOCUMENTS 6,236,731 B1 * 5/2001 Brennan et al. ..... 381/316
6,574,340 B1 6/2003 Bindner et al.

FOREIGN PATENT DOCUMENTS

EP 1 091 620 4/2001

* cited by examiner

*Primary Examiner*—Suhan Ni
(74) *Attorney, Agent, or Firm*—Schiff Hardin LLP

(57) ABSTRACT

To assist in the standardization of communication protocols and individual register models of various hearing devices, the register in the DSP/ASIC of a hearing device has a standardized interface in the DSP/ASIC. An application-specific, universal, generic command set that is transferred via the communication interface can be used therewith. Thus command set can be standardized over hearing device families, IC generations and across manufacturers, such that a universal software for adaptation of hearing devices can be achieved.

11 Claims, 2 Drawing Sheets

HEARING DEVICE WITH INDIVIDUALLY CONFIGURABLE HARDWARE INTERFACE

BACKGROUND OF THE INVENTION

1. Field of the Invention

The present invention concerns a hearing device of the type having a storage device to store setting data of the hearing device and an interface device for data communication with the storage device. The present invention also concerns a method to adapt such a hearing device.

2. Description of the Prior Art

Modern hearing devices are being continually developed by implementing new signal-processing features in circuits that are a part of an integrated circuit (IC) in the hearing device. The time span between the original development of a circuit and its next generation is generally a few years. Consequently, multiple hearing device families and generations are always on the market.

For patient-specific adaptation of hearing devices, a knowledgeable and technically competent person (acoustician) makes adjustments to the hearing device, by applying signal-processing concepts that the acoustician understands. The acoustician is aware of concepts related to the signal-processing teachings such as, for example, amplification, compression concept, knee point, compression ratio, etc. These signal-processing concepts are of a general nature and thus remain viable longer than the time span between the development of successive hearing device generations. For example, hearing device controllers that embody such signal-processing concepts are implemented in multiple successive hearing device generations.

A further development of the signal-processing technology experientially leads to new concepts being created (for example, voice activity detection (VAD) or fast attack noise cancellation (FANCY)) that are first implemented as a new development in a hearing device generation, become established, and are likewise implemented in the same form in subsequent generations. In addition, it appears that many signal-processing concepts are established industry-wide and are thus used by a larger field than the specific clientele of an individual hearing device manufacturer.

High-end hearing device platforms are developed wherein the overall signal-processing in general embodies the newest state of the art, implemented on one IC. The IC is provided with an interface that enables access to the signal-processing units of the IC, for a readout and as well as adjustment of each unit. The interface is designed such that interrelated sections are handled as a hearing device controller that already embodies the aforementioned signal-processing concepts.

Similar to a universal hearing device platform, these hearing device controllers are present not only in large numbers, but also each single one of the hearing device controllers has a broadly designed, considerable adjustment range. In order to bring various hearing devices using a hearing device platform to market, a universal software package is created that is not only able to work with all hearing device controllers in their respective full scopes, but also can be configured so that it uses only a limited selection of hearing device controllers and among those may use only a limited adjustment range. By means of this configuration procedure, a universal platform is therefore customized for a specific hearing device for which the software effects all actions that are initiated by the end user.

The customized software is designed in layers, such that a reduction of the platform-specific hearing device controller space to the device-specific hearing device controller space is achieved in a first layer. The device-specific controller space is provided with an interface of a further software layer. In this second software layer, an interpreter is housed that executes sequences of program commands in which it modifies the current hearing device controller states corresponding to these program commands. This type of operation to describe, for example, in European Application 109 16 20. A third software layer that has a user interface for the end user and receives input commands from the end user is superordinate to the second software layer. Such an input command can effect, for example, a loading of a program command sequence that is executed in the second layer by the interpreter. A specific example of this would is the dialog unit implemented in adaptation software, such a dialog unit listing a series of typical auditory situations and names corresponding thereto, presented as a menu selection. Each of the selection points causes the interpreter to execute a program command sequence that adjusts the hearing device corresponding to the named problem in order to achieve an improvement in the hearing sensation. Such a method is described in U.S. Pat. No. 6,574,340.

Moreover, each hearing device generally has a proprietary communication protocol. Furthermore, each hearing device has a specific individual register model. Attempts at standardization of the communication protocols and register models have not yet succeeded. Alone, freely programmable hearing devices would offer the possibility of such standardization, but at the cost of a very high surface area and current requirement with high complexity. Only external software is described in the aforementioned U.S. Pat. No. 6,574,340, and this software provides only a generalized interface in the form of macros and converts these into IC-specific register modifications and communication signals.

SUMMARY OF THE INVENTION

An object of the present invention is to provide a hearing device and operating method that allow the use of a unified command set spanning hearing device families and generations for adaptation of hearing devices, satisfying a requirement for small and specialized software modules for hearing device control, for example, by means of a smartphone.

This object is inventively achieved by a hearing device with a first storage device to store setting data of the hearing device and an interface device for data communication of an external device with the first storage device, with the interface device in the hearing device being implemented as hardware and the interface device being individually configurable.

The above object also is achieved by a method for adaptation of such a hearing device by preparation of the hearing device, preparation of a universal command set, interpretation of a command of the universal command set, interpretation of a command of the universal command set, masking of the interpreted command corresponding to the type of the hearing device, and access to the first storage device according to the masked, interpreted command.

In a specific case, tasks that were previously effected by the software package are thus inventively shifted to the IC of the hearing device. The configuration of a universal platform for an individual hearing device and the interpreter thus can be implemented in the IC. The tasks that are still to be handled by the software are comparably small, such that, for example, a fitting assistant (dialog unit of the adaptation software) can be implemented in a mobile hardware (smartphone/cell phone).

The interface device provided in the inventive hearing device can include an allocation unit with which data packets from or for the first storage device can be semantically associated. The access to the register or the first storage device by means of hardware can ensue via standardized register language.

The interface device preferably includes a masking unit with which a predetermined part of the data transferable via the interface device can be masked. Standardized program commands for high-end devices and low-end devices can therewith be masked differently with regard to their length, dependent on the hearing device type.

Moreover, a calculation device that is connected to the interface device can be integrated into an inventive hearing device for execution of program commands. Thus, for example, the program commands to be implemented for adaptation can be directly executed in the hearing device and an external PC for this can be foregone.

Given a calculation device integrated into the hearing device, a second storage device to store program commands advantageously is also integrated into the hearing device. Macro commands can be stored in this second storage device in a domain-specific language. The calculation device should then possess interpreter functionality.

For the development of hearing device generation-spanning command sets, overarching signal-processing concepts (as described above) should be used. A hearing device command set is therefore inventively provided having a central component for an adjustment of signal-processing control variables such as, for example, amplification, compression concept, knee point, compression ratio, etc. This hearing device command set is thereby designed from the beginning for expandability, such that signal-processing control variables that are defined only in the future can be incorporated into the command set by a simple expansion of the vocabulary, generally without redefinition or expansion of the syntax.

As already mentioned, the signal-processing control variables can be associated with the controllers of a hearing device. This associability is ensured over all software layers. In contrast to this, with the development of a new hearing device generation, hearing device controllers that assume the same function as in the preceding generation are addressed differently. As the case may be, the format of such a hearing device controller also may be different from that of its preceding generation. For example, a larger number of bits are used in the hardware register. The invention therefore also allows definition of standardized but expandable system of addresses and formats for hearing device controllers for implementation on the IC. This system could then be maintained from a first hearing device generation for every successive generation. Moreover, the interpreter in accordance with the invention is implemented such that it modifies or reads out the hearing device controller in this standardized system, initiated by corresponding program commands.

The congruent conception of the address/format system for hearing device controllers with the vocabulary of the hearing device programming language offers the following advantages:

1. Forward Compatibility:

The system achieves a standard for hearing device controllers of established signal-processing control variables that can be used again from the first implementation on the hearing device-IC in the same form in every hearing device generation.

2. Expandability:

The system is based on expandability to new hearing device controllers without abandoning the advantage of the forward compatibility.

3. Attractiveness for Achievement of Manufacturer-spanning Standards:

Since the standardized hearing device controllers that in part generate signal-processing control variables that are established industry-wide, the inducement exists to achieve an industry-wide standard.

Since the invention also provides that the interpreter on the integrated circuit is provided with a outward-directed interface via which hearing device programs or individual hearing device program commands can be transferred, an interface for a domain-specific (meaning a language that operates with concepts of the application field) programming command set is available at this point. This interface economically induces the development of smaller software modules that are possibly available on various platforms applicable for multiple generations and multiple manufacturer spanning.

DESCRIPTION OF THE PREFERRED EMBODIMENTS

Figure 2:
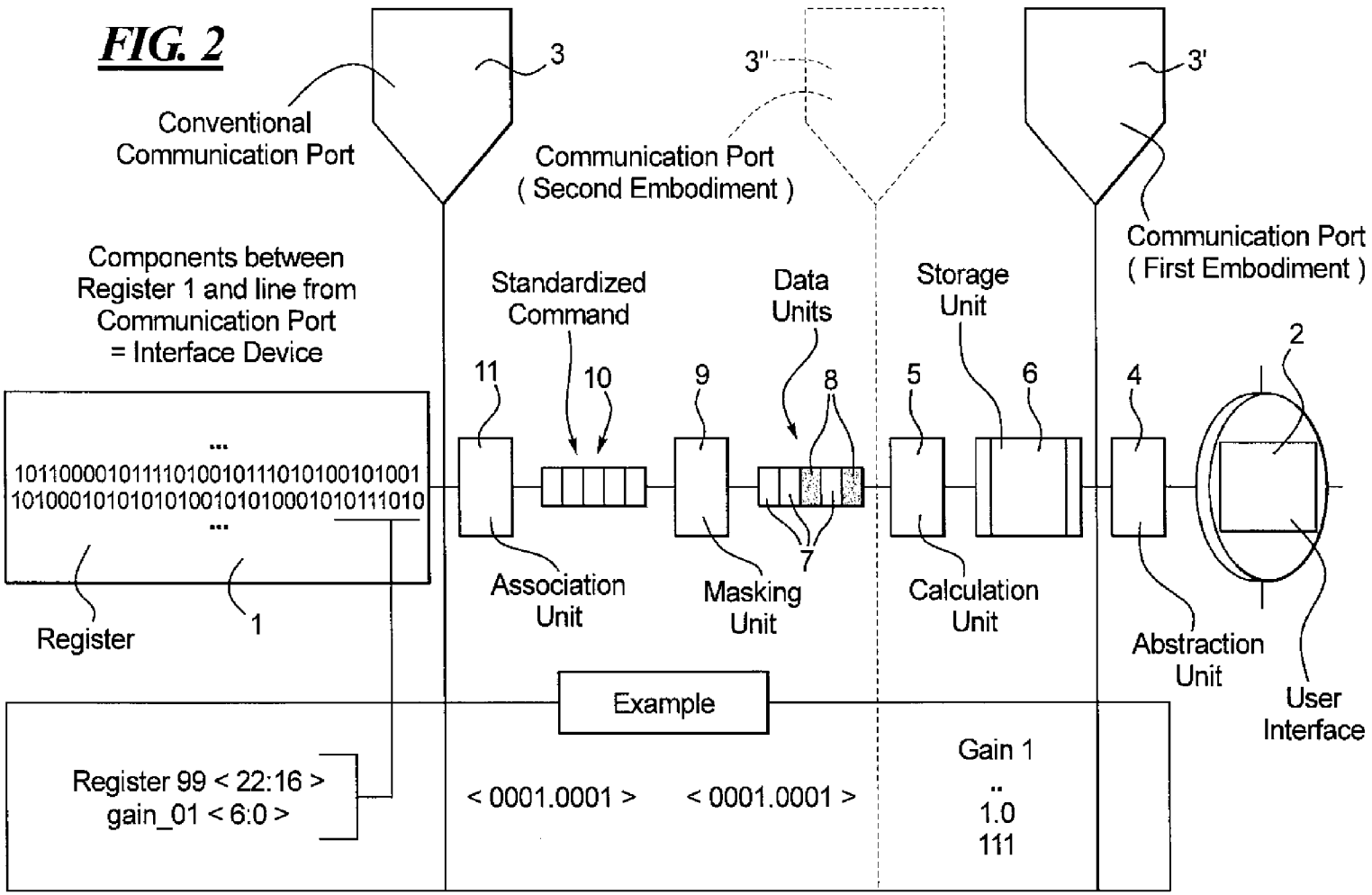
FIG. 2 is a block diagram of the basic functional units for the adaptation of the hearing device according to the present invention that is schematically shown in FIG. 1.

As shown in FIG. 2, when a hearing device is to be adapted to a hearing device user, a register 1 in which the setting values of the various hearing device controllers are stored is manipulated by means of a user interface 2 that is installed on a PC. According to the register model of the hearing device standardized here, each bit stands for a configuration of a signal-processing component.

According to the prior art, the register 1 is arranged on the IC of the hearing device. A communication port 3, such as a HIPRO port, is typical in hearing devices to allow access of an external software (controlled by the user interface 2) to the register 1. According to the convention of FIG. 2, for each communication port, all components between the register 1 and the line leading from the respective communication port represent the hearing device interface. All components between the conventional communication port 3 and the user interface 2 are executed as PC software according to the prior art, and thus only the communication port 3 constitutes the interface.

Figure 1:
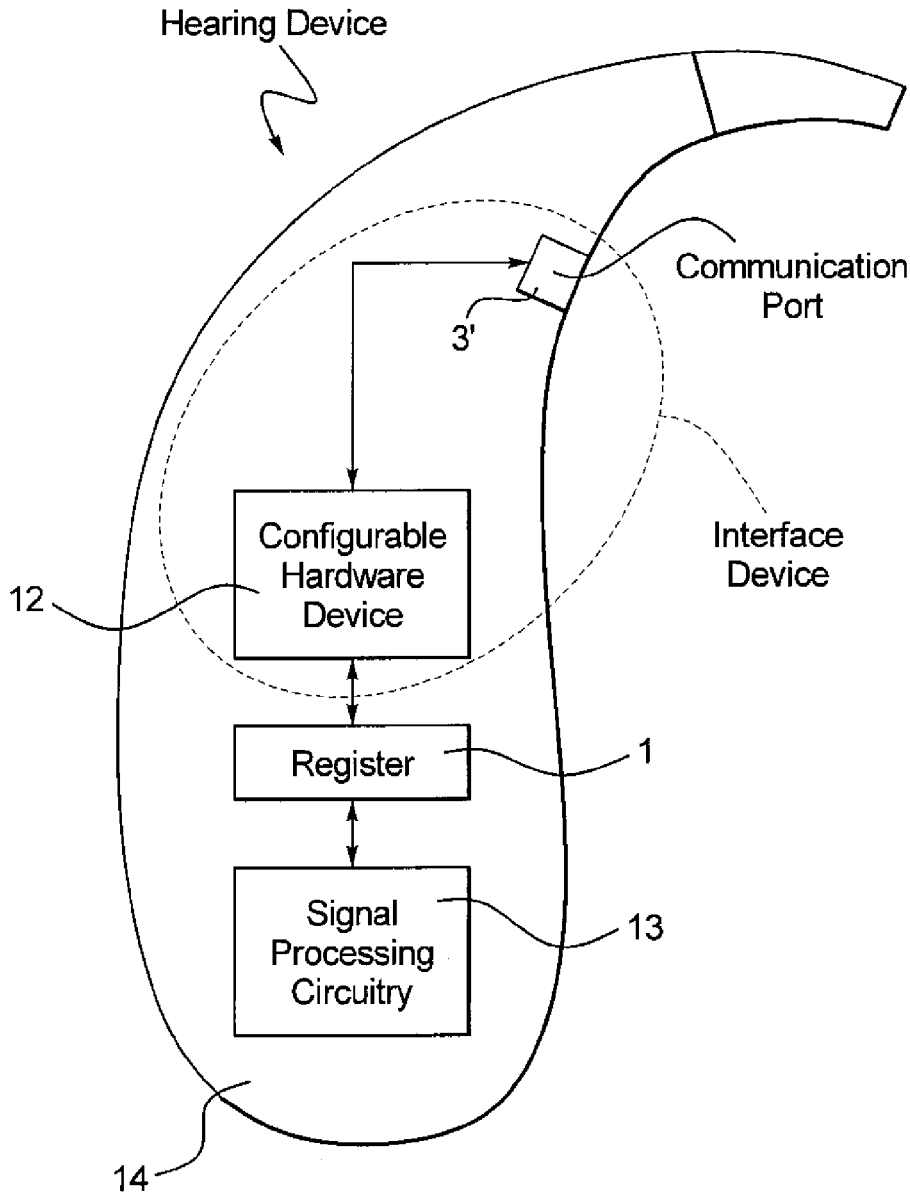
FIG. 1 schemqatically illustrates a hearing device according to the present invention.

In order to reduce the software size and to achieve a standardization of the register model and of the communication protocol, a majority of the data processing components between the register 1 and the user interface 2 are inventively executed as hardware. As shown in FIG. 1, a hearing device in accordance with the present invention has a communication port 3' connected to a configurable hardware device 12 that, in combination with the communication port 3', forms the interface of the hearing device in accordance with the present invention. The interface is connected to the register 1 that is also shown in FIG. 2, which is, in turn, as is conventional, connected to signal processing circuitry 13 of the hearing device. All components are contained in a hearing device housing 14 that is configured to be worn by a user of the hearing device.

In a first embodiment, only an abstraction unit 4 that is downstream from the user interface 2 is still implemented as software. This abstraction unit then directly communicates with a communication port 3' that may be a HIPRO port or a wireless port. This communication port 3' establishes a connection to a calculation unit 5 and a storage unit 6 connected therewith, both of which are installed on the hearing device IC. Program commands or, respectively, macros from the storage unit 6 are executed in the calculation unit 5. These macros or commands are formulated in a domain-specific language for manipulation of a hearing device control or global access control. The desired commands are activated by the abstraction unit 4.

To execute the commands in the calculation unit 5, the hearing device-specific commands are associate with the standardized command set. For example, the command for adjustment of the amplification in a specific frequency band for a high-end device with many setting possibilities is composed of five data units 7 and 8. The same command can be composed of fewer data units 7 for a low-end hearing device since this device possesses fewer setting possibilities. The unused data units 8 are therefore masked by a masking unit 9 upon readout from the register 1. In a reversal of the masking process, the unused data units 8 must therefore by expanded again upon access to the register 1 for use of the standardized command syntax in the low-end device. The standardized command 10 thus obtained is semantically associated with the register units in an association unit 11.

With this first embodiment in which the calculation unit 5 and the storage unit 6 are arranged on the hearing device IC, it is possible to accomplish complex optimization tasks with a hearing device even without the assistance of an external PC. For example, the groups of amplifications applicable for these situations can be reduced with the hearing device itself when an hearing device user perceives dish rattling or newspaper rustling through his hearing device as too loud.

However, in the event that the need exists to prepare only simple adjustment possibilities on the hearing device, such as, for example, loud, quiet or the activation and deactivation of signal tones, according to a second embodiment of the present invention it is sufficient when only the association unit 11 and the masking unit 9 are realized as hardware on the hearing device IC in addition to the register 1. The communication port 3" is then correspondingly arranged immediately after the masking unit 9.

In the concrete syntax example shown in the lower half of the figure, a command to change an amplification is reproduced in the syntax of the respective data processing unit. The masking or unmasking step, however, cannot be recognized in this example since only a selection from a number of commands or a back-association with a number of commands ensues via the masking or unmasking step.

The register model in the DSP/ASIC of the hearing device thus possesses a standardized interface. The hearing device then no longer receives commands such as "write the contents 10111000101001010 . . . in register Nr. 99" at the communication interface as has been conventional, but instead receives the standardized command "G1, Steps up, 1" and translates this into internal register contents. An application specific, universal, generic command set is therewith defined that is transferred via the communication interface. This command set can be standardized over hearing device families, IC generations and across manufacturers, such that a universal software for adaptation of hearing devices can be achieved. The command set properties are defined as follows:

application specific: specialized commands are received and interpreted at the interface for the audiological range.

universal: the command set can be used for each functionality of the adaptation software and for each forthcoming hearing device family and generation.

generic: the command set is designed such that it reproduces the same functions identically over generations of hearing devices, however allows function expansions.

If these command set is standardized across hearing device families and generations, the complexity of the adaptation software is clearly reduced. This achieves an inducement to prepare small and specialized software modules for hearing device control (for example, adaptation assistant on smartphone). The hearing device combines advantages of a freely programmable device with those of a power-saving and space-saving device. Even the customer desire for standardized software can be fulfilled. Moreover, research projects can be made easier.

Although modifications and changes may be suggested by those skilled in the art, it is the intention of the inventors to embody within the patent warranted hereon all changes and modifications as reasonably and properly come within the scope of their contribution to the art.

We claim:

1. A hearing aid device comprising:

signal-processing circuitry requiring externally supplied setting data for the operation thereof;

a register in which said setting data are to be stored; and an interface device connected to said register allowing data communication between said register and an external source for entering said setting data into said register, said interface comprising a communication port configured to receive said setting data and an individually configurable hardware device connected to the communication port.

2. A hearing device as claimed in claim 1 wherein said interface device comprises an association unit that semantically associates respective data packets from or to said register.

3. A hearing device as claimed in claim 1 wherein said interface device comprises a masking unit that masks a predetermined portion of data passing through said interface device.

4. A hearing device as claimed in claim 1 wherein said interface device comprises a calculation device connected to said communication port for executing program commands.

5. A hearing device as claimed in claim 4 comprising a storage device, separate from said register, for storing said program commands for said calculation device.

6. A hearing device as claimed in claim 4 wherein said calculation device comprises an interpreter for said program commands.

7. A hearing device as claimed in claim 4 wherein said calculation device allows said program commands to be expanded with unmodified syntax.

8. A hearing device as claimed in claim 7 wherein said calculation device employs application-specific, universal, generic program commands.

9. A hearing device as claimed in claim 1 wherein said interface device comprises a masking unit that masks a predetermined portion of data passing through said interface device, said data comprising hearing device controller data having standardized addresses and formats for a plurality of hearing devices of different types, and said masking unit masking said hearing device controller data dependent on a hearing device type.

10. A method for adapting a hearing device comprising:

providing a hearing device having a signal processor requiring setting data for the operation thereof;

providing a universal command set of said setting data to a communication port of an interface device in the hearing device having a configurable hardware device;

in said interface device, interpreting a command in said universal command set, as an interpreted command;

configuring said hardware device to mask said interpreted command dependent on a type of said hearing device; and accessing setting data stored in a register in said hearing device dependent on the masked interpreted command.

11. A method as claimed in claim 10 comprising employing a universal command set that is application-specific and generic.

* * * * *